US006117271A

United States Patent [19]

Page

[11] Patent Number: 6,117,271

[45] Date of Patent: Sep. 12, 2000

[54] SLICE LIP APPARATUS

[75] Inventor: Robert E. Page, Davis, Ill.

[73] Assignee: Beloit Technologies, Inc., Wilmington, Del.

[21] Appl. No.: 09/060,591

[22] Filed: Apr. 15, 1998

[51] Int. Cl.[7] ..... D21F 1/06

[52] U.S. Cl. ..... 162/203; 162/212; 162/344; 162/347

[58] Field of Search ..... 162/203, 301, 162/344, 347, 214, 212

[56] References Cited

U.S. PATENT DOCUMENTS

| | | | |
|---|---|---|---|
| 3,440,136 | 4/1969 | Nelson et al. | 162/203 |
| 3,578,560 | 5/1971 | Notbohm et al. | 162/344 |
| 4,124,441 | 11/1978 | Nykopp | 162/301 |
| 4,141,788 | 2/1979 | Justus | 162/301 |
| 4,416,730 | 11/1983 | Schiel | 162/344 |
| 5,084,138 | 1/1992 | Ewald | 162/301 |
| 5,160,583 | 11/1992 | Eaton et al. | 162/301 |

*Primary Examiner*—Karen M. Hastings
*Attorney, Agent, or Firm*—Lathrop & Clark LLP

[57] ABSTRACT

A slice lip apparatus is disclosed for guiding a flow of stock from a headbox so that the stock flows between a first and a second wire of a former. The apparatus includes a lip which is disposed adjacent to the first wire. A movable lip is spaced relative to the lip so that the lips defined therebetween a slice for the passage therethrough of the flow of stock. An adjustable guide shoe is disposed adjacent to the movable lip for guiding the second wire. A linkage extends between the movable lip and the adjustable guide shoe. The arrangement is such that when the movable lip is selectively moved relative to the lip, such selective movement generates a corresponding movement of the adjustable guide shoe relative to the first wire.

5 Claims, 1 Drawing Sheet

SLICE LIP APPARATUS

FIELD OF THE INVENTION

BACKGROUND OF THE INVENTION

The present invention relates to a slice lip apparatus for guiding a flow of stock from a headbox so that the stock flows between a first and a second wire of a former.

More specifically, the present invention relates to a slice lip apparatus for a gap former.

INFORMATION DISCLOSURE STATEMENT

A web is formed by ejecting pressurized stock from a headbox so that the stock flows between slice lips of the headbox to and between cooperating forming wires of a twin wire former.

A gap former is an arrangement in which the slice lips are disposed closely adjacent to an upstream end of a forming section defined between two cooperating forming wires. The wires move at approximately the same speed as the jet or flow of stock being ejected from the slice of the headbox.

In a typical headbox of the aforementioned type, trailing elements otherwise known as CONVERFLO sheets of lexan or the like extend through the headbox and the slice thereof. Such trailing elements guide the flow of stock into a gap formed between the cooperating forming wires. Such CONVERFLO sheets or trailing elements are pivotally secured at the upstream ends thereof while the downstream ends of such sheets freely float within the flow of stock.

By extending the aforementioned sheets or trailing elements into the gap, a portion of the flow of stock can be dewatered downstream relative to the remainder of the stock flow. Consequently, by such delayed dewatering of the inner layers of the web, fiber orientation of the outer layers can be controlled permitting selective control of the tensile ratio of the resultant web.

The present invention provides automatic control of the distance between the wires adjacent to the slice lip such distance being dependent upon movement of a movable lip of the slice lip apparatus.

Accordingly, it is a primary objective of the present invention to provide a slice lip apparatus which overcomes the problems associated with the prior art gap formers and which provides a considerable contribution to the art of ejecting a flow of stock into a gap former.

Other objects and advantages of the present invention will be readily apparent to those skilled in the art by a consideration of the detailed description contained hereinafter taken in conjunction with the annexed drawings.

SUMMARY OF THE INVENTION

The present invention relates to a slice lip apparatus and method for guiding a flow of stock from a headbox so that the stock flows between a first and a second wire of a former.

The apparatus includes a lip which is disposed adjacent to the first wire of the former.

A movable lip is spaced relative to the lip with the lips defining therebetween a slice for the passage therethrough of the flow of stock.

An adjustable guide shoe is disposed adjacent to the movable lip so that the guide shoe guides the second wire.

A linkage means extends between the movable lip and the guide shoe. The arrangement is such that when the movable lip is selectively moved relative to the lip, such selective movement generates movement of the adjustable guide shoe relative to the first wire.

In a more specific embodiment of the present invention, the slice lip apparatus further includes a stationary guide shoe for guiding the first wire.

Also, the stationary guide shoe is fabricated from a ceramic so that frictional wear due to movement of the first wire relative to the stationary shoe is inhibited.

In a preferred embodiment of the present invention, the lip is a stationary lip and the movable lip has a proximal and a distal end.

The apparatus further includes a lower wall of the headbox. The arrangement is such that the proximal end of the movable lip is pivotally connected to the lower wall.

More specifically, a knuckle joint is disposed between the movable lip and the lower wall, the knuckle joint permitting the movable lip to pivot relative to the lower wall.

A plurality of trailing elements extend through the slice with the elements being disposed between the wires so that a portion of the stock flows between the elements to a point which is disposed downstream relative to the guide shoe so that dewatering of the stock between the elements is accomplished downstream relative to the adjustable guide shoe.

The adjustable guide shoe is fabricated from ceramic so that when the second wire moves relative to and is guided by the adjustable shoe, frictional wear of the second wire is minimized.

In a specific embodiment of the present invention, a linkage means includes a stationary trunnion and an extension which is rigidly secured to the movable shoe. The extension is pivotally secured to the trunnion for permitting movement of the adjustable shoe and the second wire guided therepast towards and away from the first wire.

The linkage means also includes an arm which has a first and second end. The first end is rigidly secured to the movable lip and the second end is pivotally secured to the extension. The arrangement is such that movement of the movable lip rotates the arm such that the extension and adjustable shoe move relative to the first wire.

More specifically, the second end of the arm defines a slot and the extension includes an upstanding pin. The pin cooperates with the slot to define a lost motion mechanism for transmitting movement of the movable slice lip to the adjustable shoe.

More specifically, the slice lip apparatus includes a first dewatering shoe which is disposed adjacent to the first wire and a second dewatering shoe which is disposed adjacent to the second wire. The dewatering shoes are disposed downstream relative to the adjustable guide shoe.

A plurality of trailing elements extend through the slice and between the wires and the dewatering shoes for directing a portion of the flow of stock to a point downstream relative to the dewatering shoes so that dewatering of the portion of the stock begins downstream relative to the dewatering shoes. The linkage means permit selective adjustment of a remainder of the flow of stock for controlling a tensile ratio of a resultant formed web.

Many modifications and variations of the present invention will be readily apparent to those skilled in the art by consideration of the detailed description contained hereinafter.

However, such modifications and variations fall within the spirit and scope of the present invention as defined by the appended claims.

DETAILED DESCRIPTION OF THE DRAWINGS

Figure 1:
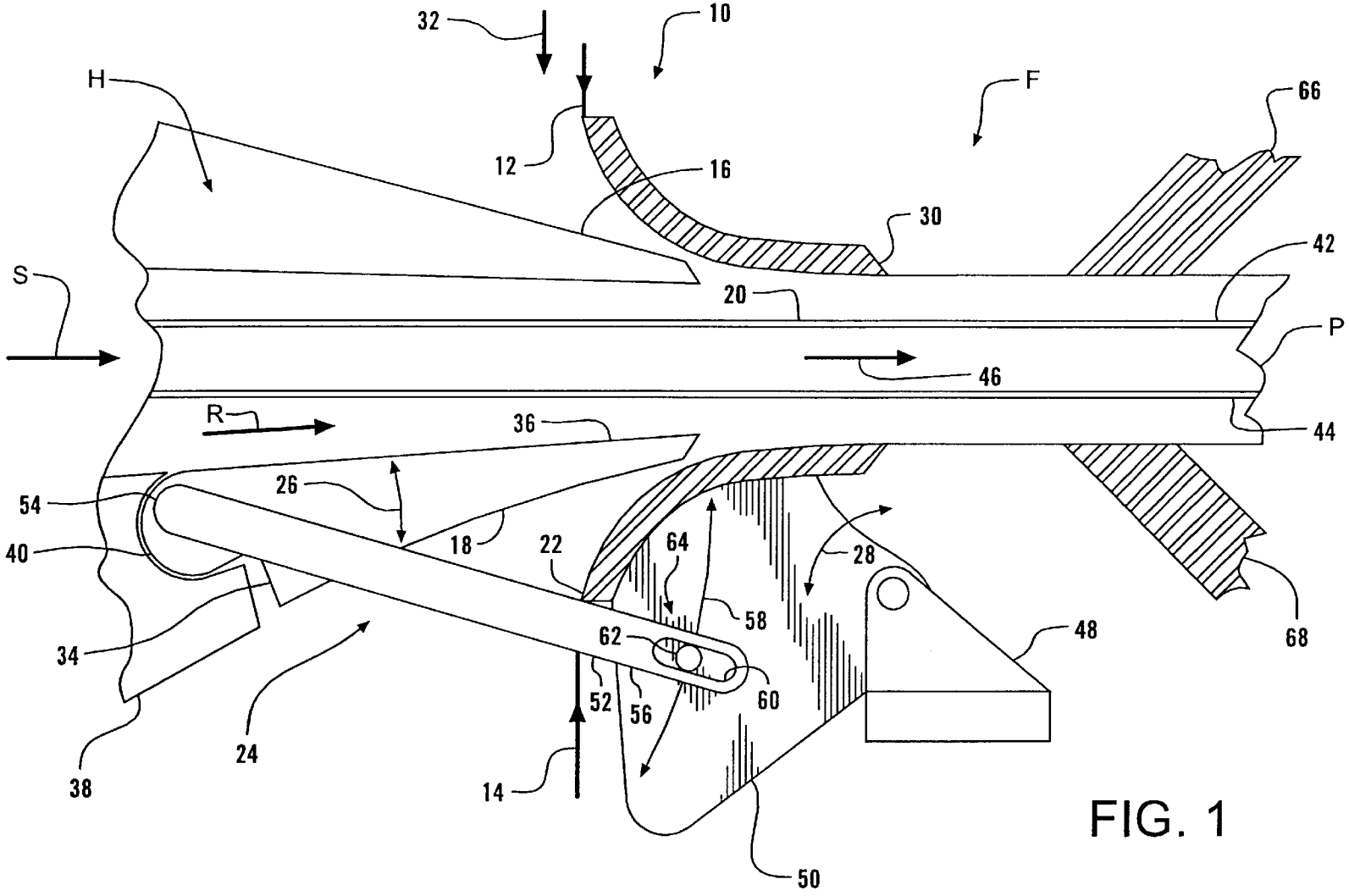
FIG. 1 is a side elevational view of a slice lip apparatus according to the present invention.

FIG. 1 is a side elevational view of a slice lip apparatus generally designated 10 according to the present invention for guiding a flow of stock as indicated by the arrow S from a headbox generally designated H so that the stock S flows between a first and a second wire 12 and 14, respectively, of a former generally designated F.

The apparatus 10 includes a lip 16 which is disposed adjacent to the first wire 12 of the former F.

A movable lip 18 is spaced relative to the lip 16 with the lips 16 and 18 respectively defining therebetween a slice 20 for the passage therethrough of the flow of stock S.

An adjustable guide shoe 22 is disposed adjacent to the movable lip 18 for guiding the second wire 14.

A linkage means generally designated 24 extends between the movable lip 18 and the guide shoe 22. The arrangement is such that when the movable lip 18 is selectively moved relative to the lip 16 as indicated by the arrow 26, such selective movement 26 generates movement as indicated by the arrow 28 of the adjustable guide shoe 22 relative to the first wire 12.

As shown in FIG. 1, the apparatus 10 further includes a stationary guide shoe 30 for guiding the first wire 12.

More specifically, the stationary guide shoe 30 is fabricated from a ceramic so that frictional wear due to movement as indicated by the arrow 32 of the first wire 12 relative to the stationary guide shoe 30 is inhibited.

As shown in FIG. 1, the lip 16 is a stationary lip.

The movable lip 18 as shown in FIG. 1 has a proximal and a distal end 34 and 36, respectively. The apparatus 10 also includes a lower wall 38 of the headbox H. The arrangement is such that the proximal end 34 of the movable lip 18 is pivotally connected to the lower wall 38.

More specifically, as shown in FIG. 1, a knuckle joint 40 is disposed between the movable lip 18 and the lower wall 38. The knuckle joint 40 permits the movable lip 18 to pivot as indicated by arrow 26 relative to the lower wall 38.

The apparatus 10 also includes a plurality of trailing elements 42 and 44 respectively which extend through the slice 20. The elements 42 and 44 are disposed between the wires 12 and 14 so that a portion of the stock S flows as indicated by the arrow 46 between the elements 42 and 44 to a point P which is disposed downstream relative to the adjustable guide shoe 22 so that dewatering of the stock between the elements 42 and 44 is accomplished downstream relative to the adjustable guide shoe 22.

The adjustable guide shoe 22 is fabricated from a ceramic so that when the second wire 14 moves relative to and is guided by the adjustable shoe 22, frictional wear on the second wire 14 is minimized.

The linkage means 24 includes a stationary trunnion 48 and an extension 50 which is rigidly secured to the adjustable shoe 22. The extension 50 is pivotally secured to the trunnion 48 for permitting movement as indicated by the arrow 28 of the adjustable shoe 22 and the second wire 14 guided therepast towards and away from the first wire 12.

Also, an arm 52 which has a first and a second end 54 and 56 respectively is rigidly secured at the first end 54 thereof to the movable lip 18. The second end 56 of the arm 52 is pivotally secured to the extension 50 so that movement of the movable lip 18 rotates the arm 52 as indicated by the arrow 58 such that the extension 50 and adjustable shoe 22 move relative to the first wire 12.

More specifically, as shown in FIG. 1, the second end 56 of the arm 52 defines a slot 60. Also, the extension 50 includes an upstanding pin 62 which cooperates with the slot 60 to define a lost motion mechanism generally designated 64 for transmitting movement of the movable slice lip 18 to the adjustable guide shoe 22.

The apparatus 10 further includes a first dewatering shoe 66 as shown in FIG. 1 which is disposed adjacent to the first wire 12.

Also, a second dewatering shoe 68 is disposed adjacent to the second wire 14 with the dewatering shoes 66 and 68 being disposed downstream relative to the adjustable guide shoe 22.

The plurality of trailing elements 42 and 44 extend through the slice 20 and between the wires 12 and 14 and dewatering shoes 66 and 68 for directing a portion 46 of the flow of stock S to a point P downstream relative to the dewatering shoes 66 and 68 so that dewatering of the portion of the stock 46 begins downstream relative to the dewatering shoes 66 and 68. The linkage means 24 permits selective adjustment of a remainder of the flow of stock S as indicated by the arrow R for controlling a tensile ratio of a resultant formed web.

The present invention provides a unique slice lip apparatus which provides automatic and simultaneous control of the distance between the forming wires and the slice lip opening so that the tensile ratio of the resultant web can be selectively controlled.

What is claimed is:

1. In a papermaking former, slice lip apparatus for guiding a flow of stock from a headbox so that the stock flows between a first and a second wire of the former, said apparatus comprising:

a lip disposed adjacent to the first wire of the former;

a movable lip spaced relative to said lip, said lips defining therebetween a slice for the passage therethrough of the flow of stock;

an adjustable guide shoe disposed adjacent to said movable lip, said guide shoe being in a loop of said second wire and guiding the second wire; and linkage means extending between said movable lip and said adjustable guide shoe, the arrangement being such that when said movable lip is selectively moved relative to said lip, such selective movement generates movement of said adjustable guide shoe relative to the first wire, wherein said linkage means includes a stationary trunnion;

an extension rigidly secured to said adjustable shoe, said extension being pivotally secured to said trunnion for permitting movement of said adjustable shoe and said second wire guided therepast towards and away from the first wire;

and an arm having a first and a second end, said first end being rigidly secured to said movable link, and said second end being pivotally secured to said extension so that movement of said movable lip rotates said arm such that said extension and said adjustable shoe move relative to the first wire.

2. A slice lip apparatus as set forth in claim 1 further including:

a stationary guide shoe within a loop of the first wire and for guiding the first wire.

3. A slice lip apparatus as set forth in claim 1, wherein:

said second end of said arm defines a slot;

said extension including:

an upstanding pin which cooperates with said slot to define a lost motion mechanism for transmitting movement of said movable slice lip to said adjustable guide shoe.

4. A slice lip apparatus as set forth in claim 1, further including:

a first dewatering shoe disposed adjacent to said first wire;

a second dewatering shoe disposed adjacent to said second wire, said dewatering shoes being disposed downstream relative to said adjustable guide shoe.

5. A method for guiding a flow of stock from a headbox so that the stock flows between a first and a second wire of a gap former, said method comprising the steps of:

moving a moveable slice lip of a the headbox relative to a stationary slice lip, the arrangement being such that the slice lips define therebetween a slice for the passage therethrough of the flow of stock; and linking the movable slice lip to an adjustable guide shoe which is disposed adjacent to the movable slice lip, the adjustable guide shoe being inside of and guiding the second wire; the linking arrangement being such that when the movable slice lip is selectively moved relative to the stationary lip, such selective movement generates movement of said adjustable guide shoe relative to the first wire, wherein said linking arrangement includes a stationary trunnion;

an extension rigidly secured to the adjustable shoe, the extension being pivotally secured to the trunnion for permitting movement of the adjustable shoe and the second wire guided therepast towards and away from the first wire; and an arm having a first and a second end, the first end being rigidly secured to said movable link, and the second end being pivotally secured to the extension so that movement of the movable lip rotates the arm such that the extension and the adjustable shoe move relative to the first wire.

* * * * *